US005310127A

United States Patent [19]

Deiuri

[11] Patent Number: 5,310,127

[45] Date of Patent: May 10, 1994

[54] THREAD STORAGE AND DELIVERY DEVICE WITH ADJUSTABLE BRISTLE ALIGNMENT

[75] Inventor: Adriano Deiuri, Taverne, Switzerland

[73] Assignee: Sobrevin Société de brevets industriels-Etablissement, Vaduz, Liechtenstein

[21] Appl. No.: 948,390

[22] Filed: Sep. 21, 1992

[30] Foreign Application Priority Data

Sep. 23, 1991 [DE] Fed. Rep. of Germany ... 9111875[U]

[51] Int. Cl.[5] ..... B65H 51/20

[52] U.S. Cl. ..... 242/47.01; 242/47.12

[58] Field of Search ..... 242/47.01, 47.12, 128, 242/147 R, 47.13; 139/452

[56] References Cited

U.S. PATENT DOCUMENTS

| | | | |
|---|---|---|---|
| 3,648,939 | 3/1972 | Rosen | 242/47.01 |
| 3,702,176 | 11/1972 | Rosen | 242/47.01 |
| 3,834,635 | 9/1974 | Pfarrwaller | 242/47.01 |
| 3,926,381 | 12/1975 | Lawson et al. | 242/47.01 |
| 3,971,522 | 7/1976 | Pfarrwaller | 242/47.01 |
| 3,995,786 | 12/1976 | Deniega | 242/47.01 |
| 4,153,214 | 5/1979 | Savio et al. | 242/47.01 |
| 4,632,154 | 12/1986 | Maina | 242/47.01 X |
| 4,747,549 | 5/1988 | Balzarotti | 242/47.12 |
| 5,181,666 | 1/1993 | Bitzer | 242/47.01 |

FOREIGN PATENT DOCUMENTS

| | | | |
|---|---|---|---|
| 0326960 | 8/1989 | European Pat. Off. | 242/47.01 |

*Primary Examiner*—Stanley N. Gilreath
*Attorney, Agent, or Firm*—Martin A. Farber

[57] ABSTRACT

A thread storage and delivery device with overhead withdrawal of thread windings deposited on a storage drum having a frustoconical outer surface. The device comprises a bristle ring having bristles applied in a non-radial direction of alignment onto the frustoconical outer surface of the storage drum, the thread passing under the bristles on the drum. The ring is provided with means for changing the direction of alignment of the bristles on the outer surface of the drum.

11 Claims, 7 Drawing Sheets

THREAD STORAGE AND DELIVERY DEVICE WITH ADJUSTABLE BRISTLE ALIGNMENT

FIELD AND BACKGROUND OF THE INVENTION

The present invention relates to a thread storage.

Thread storages with rings of bristles are known in the prior art. In these known thread storages, the bristle rings serve, inter alia, to remove the thread with uniform tension from the storage drum. For this purpose, the thread is pulled between the radially inwardly facing outer surface of a head-side end region of the storage drum and the bristles of the bristle ring lying thereon. The bristles are aligned in the direction of thread travel produced by pulling off the thread. The thread is therefore always withdrawn with the course of the bristles. In known thread storages, frequently the direction of rotation by which the turns of thread lie on the storage drum must be changed depending on the nature or use of the thread. Corresponding to this change in direction of rotation, the direction of rotation of the travel of the thread during the removal of the thread also changes and, accordingly, a ring of bristles in connection with which the bristles are aligned in the opposite direction must be used.

SUMMARY OF THE INVENTION

The object of the present invention, therefore, is further to develop a thread storage of this type so that it is more advantageous in use.

This object is achieved by the invention by providing means for changing the alignment of the bristles.

As a result of this development of the invention, there is created a thread storage having a ring of bristles of improved use. The ring of bristles need not be exchanged upon changing the direction in which the thread is applied to the storage drum. The bristles, by themselves, follow the changed direction of withdrawal of the thread or are shifted so that the thread always travels with the course below the bristles. It is also provided that, in the case of an active displacement, for instance, manual, magnetic or electric, all bristles are simultaneously brought into the new direction. Magnetic or electric adjustment of the alignment of the bristles can be controlled by the electronic system controlling the drive motor of the thread storage. In all cases, however, there is assurance that thread turns deposited on the thread storage drum either in counterclockwise direction or in clockwise direction are withdrawn with the course of the bristles. For this purpose, the bristles are mounted swingably in the body of the ring. With automatic change of the alignment of the bristles, the pulling force of the thread can be used to displace the bristles from the alignment directed opposite the course into alignment in the direction of the course. One advantageous further development of the invention provides that a plurality of bristle holders which grip the bristles in bunches are inserted for swinging in the body of the bristle ring. In this connection, in accordance with another feature of the invention, the bristle holders may be cylindrical and the bristle ring body may comprise of an annular holder part which receives the bristle holders in it and an annular control part which can be used in order to shift the bristles jointly from one alignment into the other by a swinging movement of the bristle holders. The two annular parts can be turned in directions opposite each other for this. It is furthermore advantageous to mount the bristle holders spaced from each other and therefore in such a manner that the bristle holders, which are preferably of cylindrical formation, do not contact each other on their outer surfaces. For this purpose, corresponding mounting cups in which the bristle holders lie can be provided in the holder part.

The bristle holders can be provided with spacers between them so that the bristle holders are strung like beads in a row and lie in a corresponding groove in the holder part. In this embodiment, the mounting cups are thus not necessary. Another preferred embodiment of the invention arranges on the side of the bristle holder opposite the bristle outlet a control pin which engages in control slots of the control part, the control part being displaceable in rotation with respect to the holder part. By the rotary displacement of the holder part with respect to the control part, the relative position of the control slot with respect to the bristle holder is shifted so that, by the engagement of the control pin in the control slots, a rotary movement is imposed upon the bristle holders which are fixed relative to the holder part. In this way, the alignment of the bristles can be easily changed. With this latter embodiment, it is particularly advantageous for the bristles to lie in bundles in the bristle holders. Furthermore, windows for the emergence of the bristles from the body of the bristle ring can be provided on the inner side of the ring. They are preferably of frame shape. By this shape of the outlet window, a dependable spacing of the bristle holders is, on the one hand, assured while, on the other hand, the frames of the windows form a stop for the swinging movement of the bristles so that the latter can only be swung as far out of the radial as is necessary for a dependable withdrawal of the thread. In addition to the preferred embodiment of the invention in which the bristle holders are spaced from each other, there is also included within the scope of the invention, however, an embodiment where the cylindrical walls of the cylindrical, bristle bodies contact each other. This embodiment has the advantage, in particular, that one can dispense with spacers such as mounting cups or the like.

The invention is particularly advantageous where the thread storage has a turn advance which is driven by the rotary drive of the thread guide which places the thread turns on the storage drum and if this transport of the thread turns adjusts itself, on its own, upon a reversal of direction of rotation of the thread guide in such a manner that the thread turns placed on the storage drum are always conveyed towards the head-side end. In such case, no additional manipulations need be effected on the machine since the bristles automatically adapt themselves to the corresponding direction of rotation of the withdrawal of the thread.

BRIEF DESCRIPTION OF THE DRAWINGS

With the above and other and other advantages in view, the present invention will become more clearly understood in connection with the detailed description of preferred embodiments, when considered with the accompanying drawings, of which.

DETAILED DESCRIPTION OF THE PREFERRED EMBODIMENTS

Figure 1:
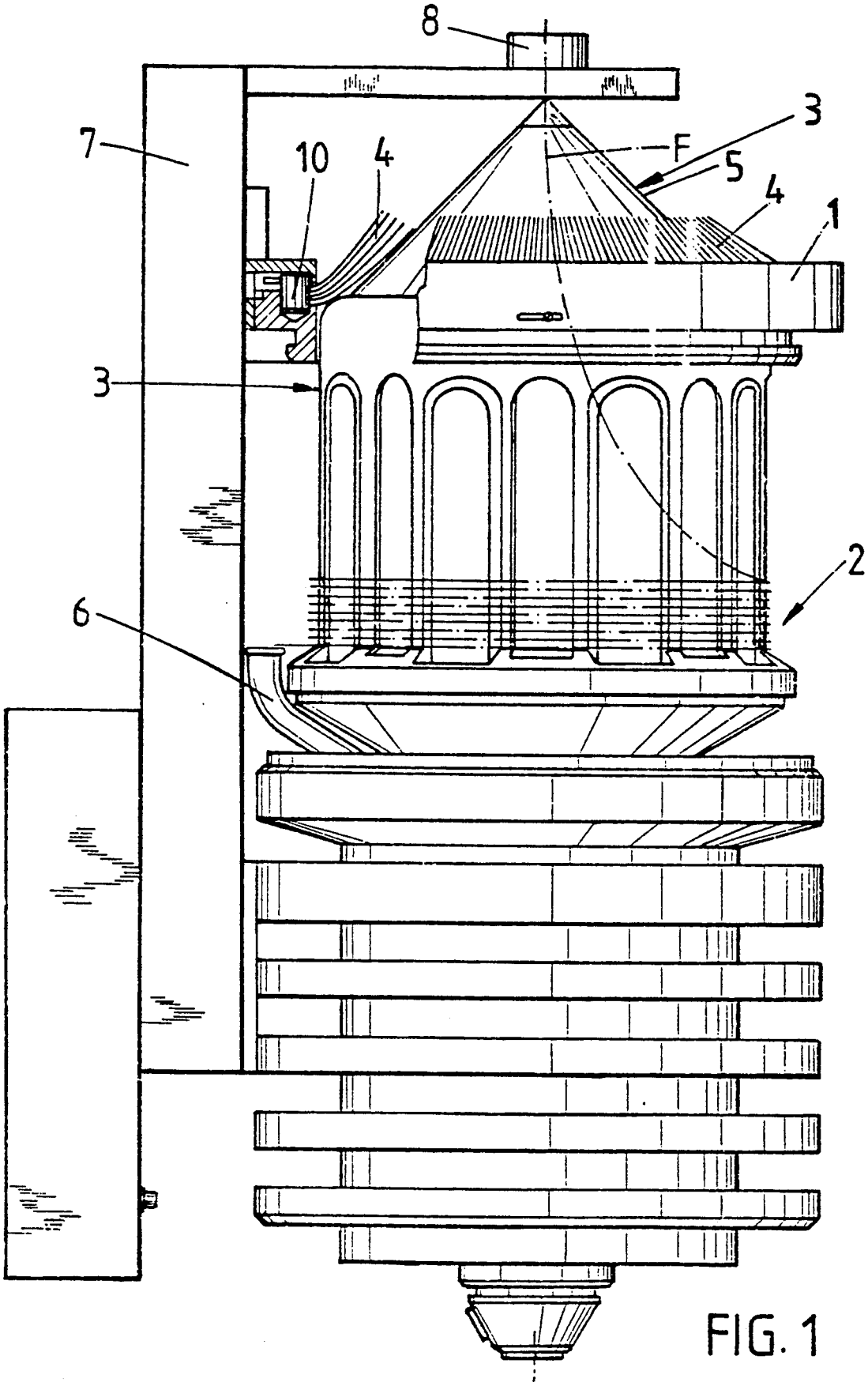
FIG. 1 shows a thread storage with a ring of bristles in the case of a first embodiment.
Figure 3:
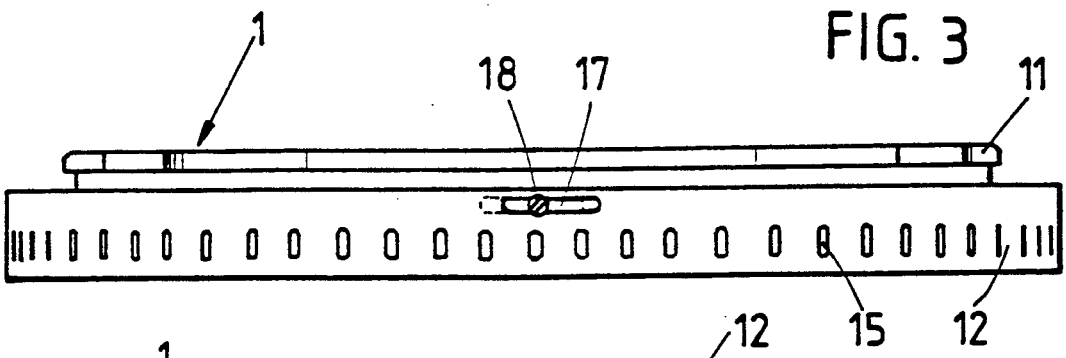
FIG. 3 is a side view of the bristle ring.
Figure 2:
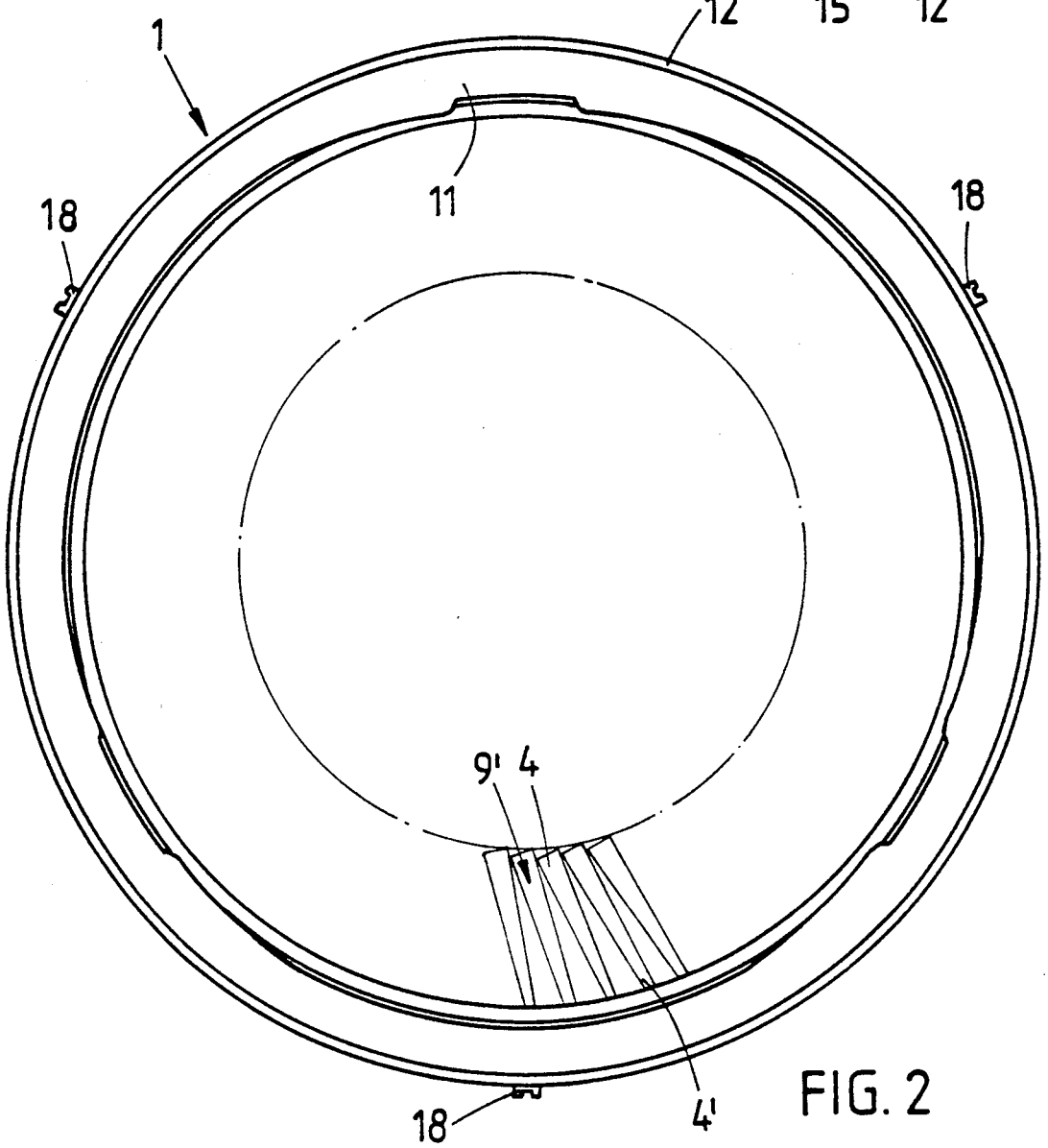
FIG. 2 shows a bristle ring in top view with, shown in part, bristles (shown in part), combined in bundles, aligned in clockwise direction.
Figure 4:
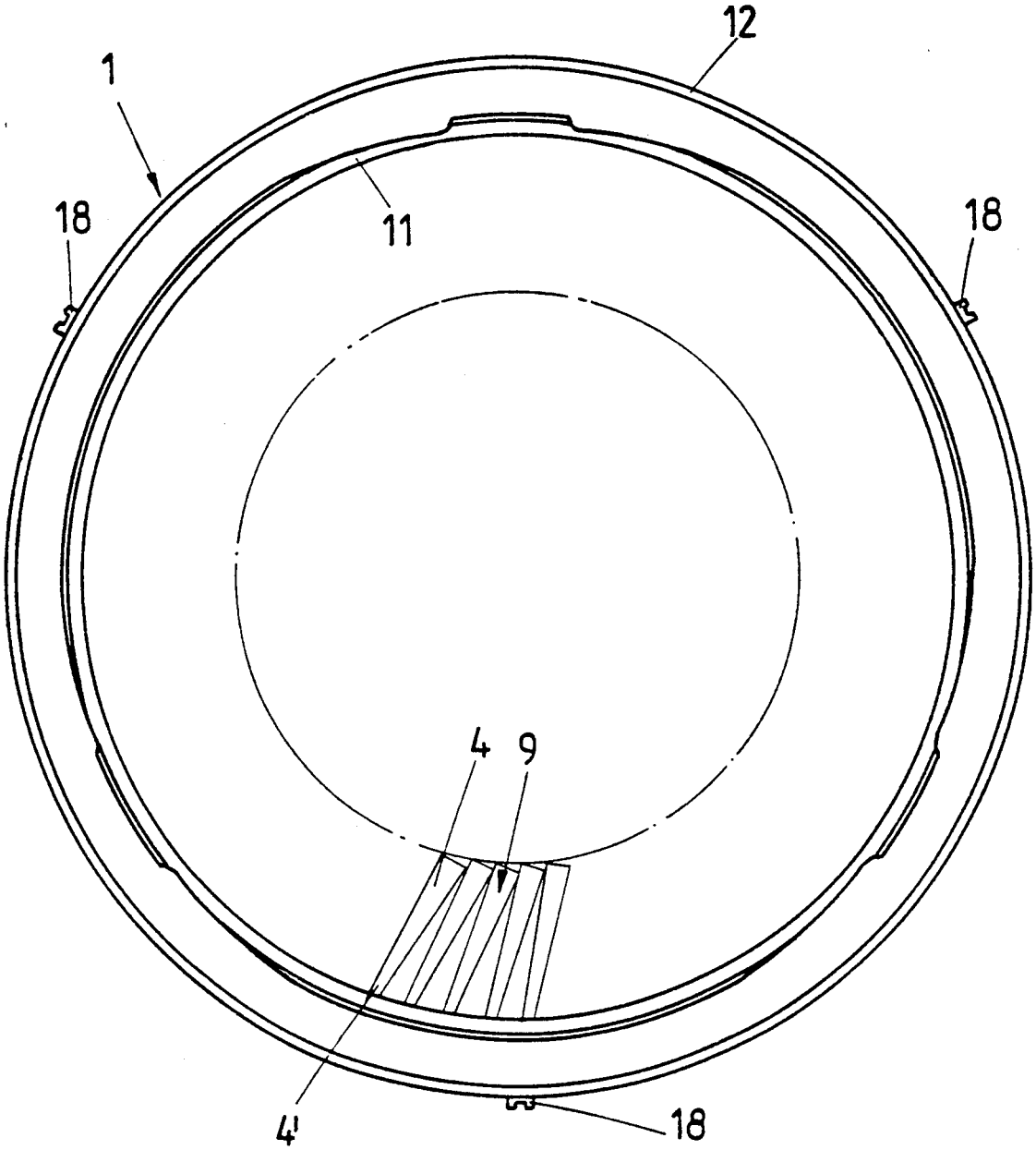
FIG. 4 is a view similar to FIG. 2, with opposite alignment of the bristles, seen in top view of a bristle ring.
Figure 5:
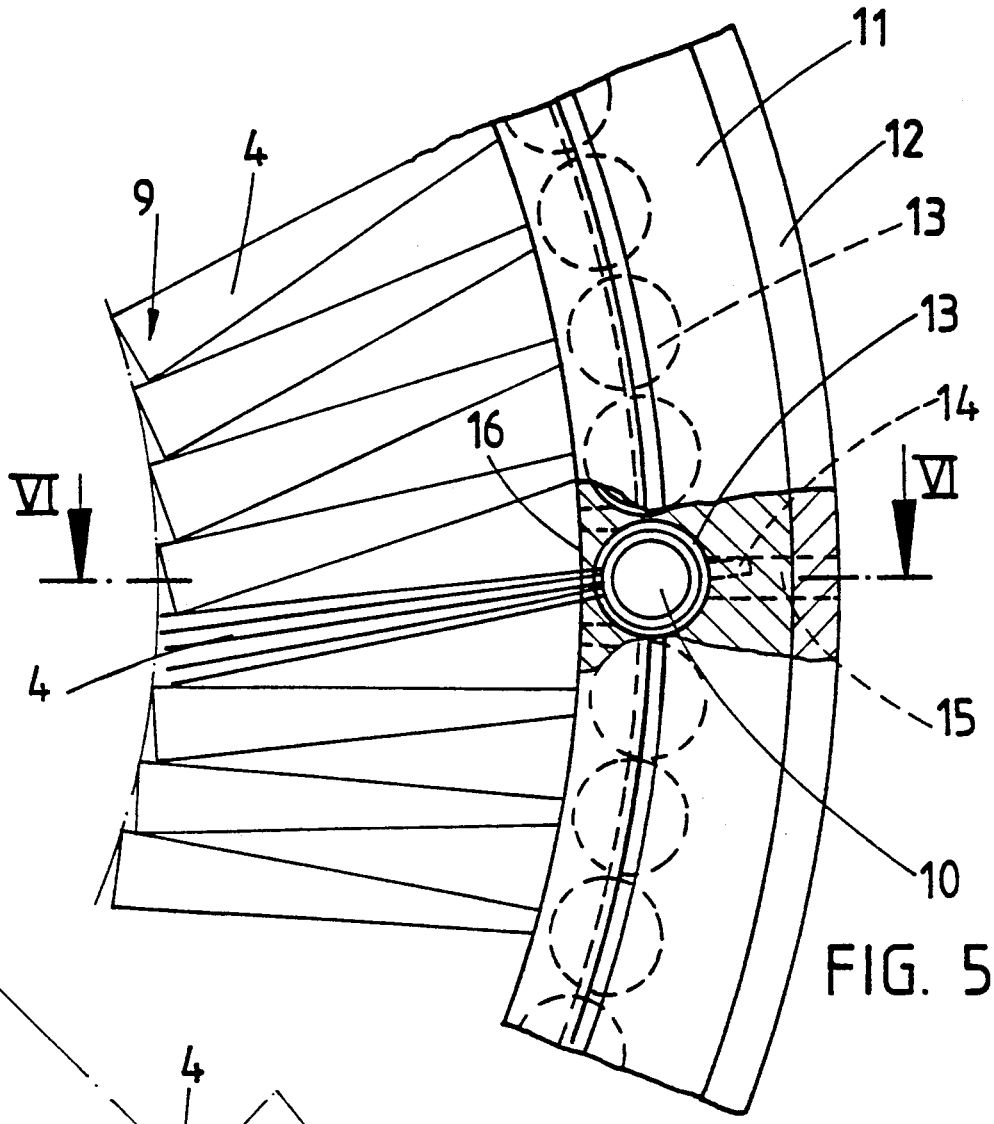
FIG. 5 is a showing of the bristle ring with a broken-away showing of the mounting of the bristle holder.
Figure 6:
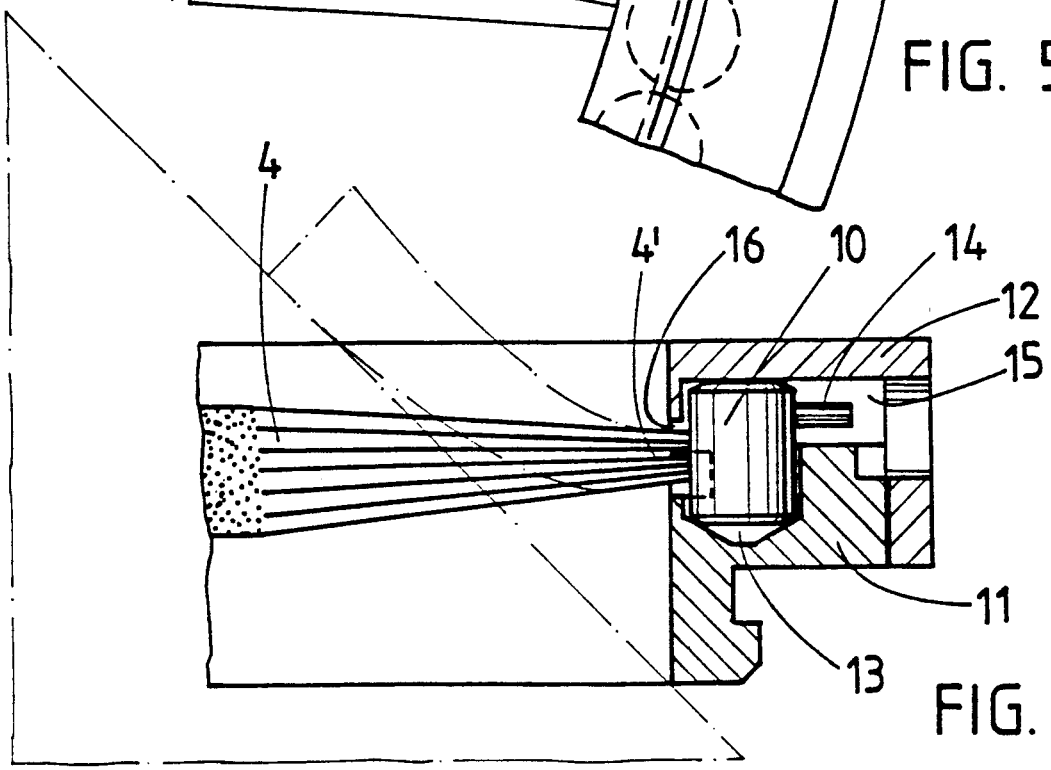
FIG. 6 is a section along the line VI—VI of FIG. 5.
Figure 7:
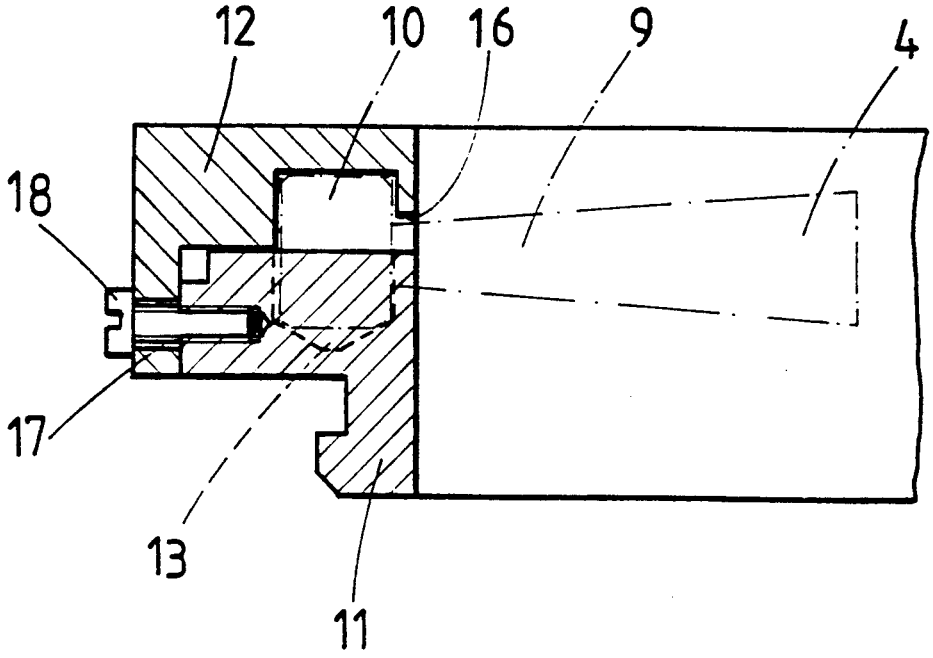
FIG. 7 is a section through the bristle ring.

FIG. 1 shows a thread storage 2 which has a storage drum 3 which is held stationary. The thread is wound on the thread storage drum by a rotating thread feeder 6. The turns of thread are transported stepwise in the direction of removal of the thread by transport means (not shown) provided in the thread storage. By adjusting the speed of transport of the thread-turn transport means, the distances apart of the individual thread turns on the storage drum 3 can be adjusted. At the same time, the advance of the thread is adjustable in such a manner that upon change of the direction of rotation of the thread feeder 6, the direction of advance remains the same. The switching from counterclockwise travel to clockwise travel of the thread turn advance can be effected in this connection either automatically or manually. The change in the alignment of the bristles can in this connection also be effected manually or by a separate drive, in which case a rotary displacement between holder part 11 and control part 12 can be effected by, for instance, a servomotor.

On the head side of the storage drum 3, the initially cylindrical outer surface of the storage drum extends directed radially inward, forming in this connection a frustoconical surface 5, there being understood by frustoconical also rounded or even cylindrical surface regions. However, the surface 5 is preferably directed inwards. It is only essential that there be present a surface region on which the bristles of the bristle ring 1 which are aligned other than radial can rest. The bristle ring 1 is fastened on a holder 7 which, in its turn, is fastened to the housing of the thread storage 2. Above the outer surface 5 of the storage drum which is strictly frustoconical in the embodiment shown, there is a thread pull-off opening 8 through which the thread F is pulled off. During the pulling, the thread F travels, corresponding to its direction of winding, below the bristles along the storage drum 3. By the application of the bristles 4 onto the surface of the storage drum, a certain braking of the thread is effected. The braking can be adjusted by a more or less strongly adjusted bristle curvature by axial displacement of the bristle ring 1. Between the ring body 1 and the outer surface of the storage drum there is sufficient room for the thread to be withdrawn without disturbance.

The bristle ring 1 comprises a lower, annular holder part 11 and an upper control part 12 which is mounted for rotary displacement with respect to the holder part 11. The holder part is provided, over its entire circumference, with a large number of mounting cups 13 which are cylindrical in shape and in which the bristle holders 10 are contained. A total of 71 bristle holders are provided, their bristles extending into the inside of the ring.

The substantially cylindrical bristle holders have radially protruding bundles of bristles. The bundles of bristles 9 consist of a plurality of several bristles 4 and are arranged approximately centrally in the bristle holder 10. On the side opposite the bristle outlet 4', the bristle holder 10 has a control pin 14 which is not arranged centrally but rather in the upper fourth of the bristle holder 10.

The lower half of each bristle holder 10 lies rotatably within a mounting cup 13. The mounting cup 13 has a conical bottom surface on its cylinder bottom. On the inside of the ring there is associated with the mounting cup a frame-shaped outlet window 16 through which the bundle of bristles 9 extends into the inside of the ring. The width of the window is greater than the emergence diameter of the bristle bundle 9 so that swingability of the bundle of bristles is limited by the frame.

In order to receive the control pins, the control part which extends over the bristle holders 10 on the top has correspondingly developed control slots 15. The width of the control slots 15 is such that, in order to change the alignment of the bristles, the control pins can be acted on in each case by one side of the control slot 15. This action takes place in the manner that the holder part 11 and control part 12 are being turned relative to each other. In this way, active manual adjustability is established. If the swinging movement of the bristle holders and the rotational displaceability of control part 12 and holder part 11 are so easily movable that as a result of the action of the bristles a turning movement can be transferred via the control pin 14 to the control part 12, automatic shifting is possible. The control part 12 forms a slide surface which rests slidingly on the head surfaces of the bristle holders 10.

The shifting of the bristles 4 is effected in this connection by the thread F traveling in the other direction. In this way, the bristles which are initially aligned opposite the direction of travel of the thread are aligned with the travel of the thread. In the event of manual change of the alignment of the bristles, only control part 12 and holder part 11, on the other hand, need be turned with respect to each other. The control part 12 is fastened by screws 18 which pass through a slot 17 in the control part 12 and are screwed in the holder part 11. By means of the slot 17, the rotational displaceability of the two rings (11 and 12) is established. A stop limitation of the rotary movement of control part 12 and holder part 11 can be established on the one hand by the width of the control slot 15 but on the other hand also by the width of the outlet opening 16.

Figure 8:
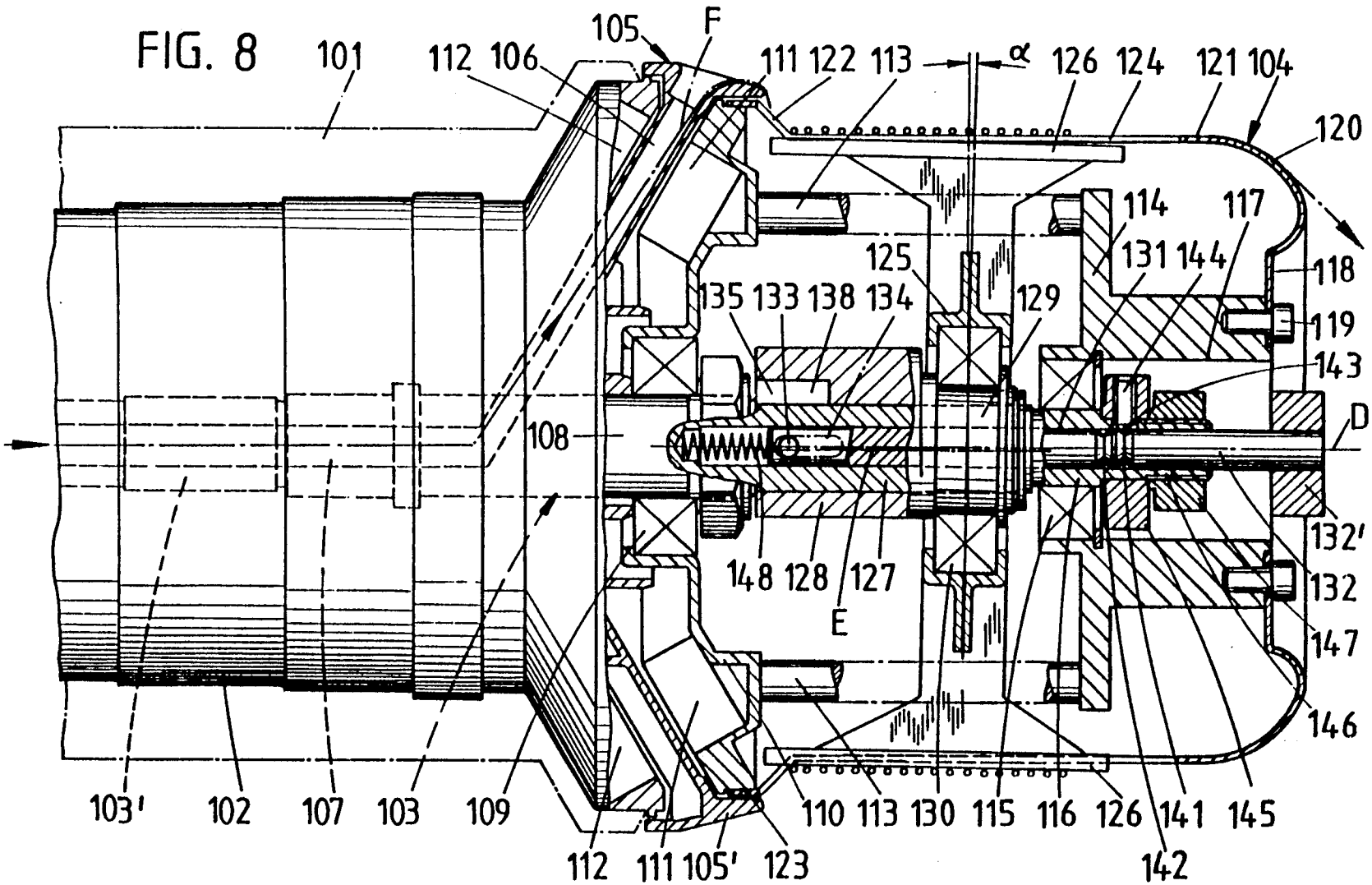
FIG. 8 is a section through a thread storage body of a second embodiment, the bristle ring not being shown.
Figure 9:
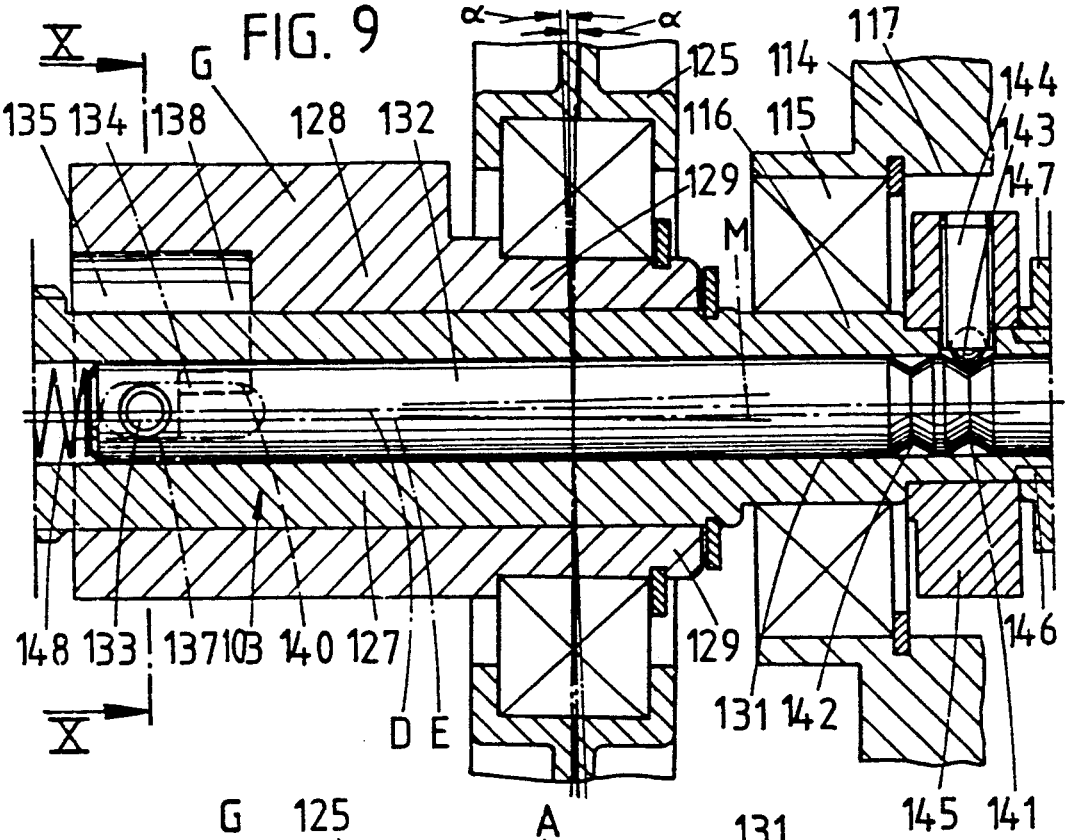
FIG. 9 is a longitudinal section on a larger scale through the thread storage in the region of the mounting cup, the actuating rod, and the holder in the one stop position of the coupling pin.
Figure 10:
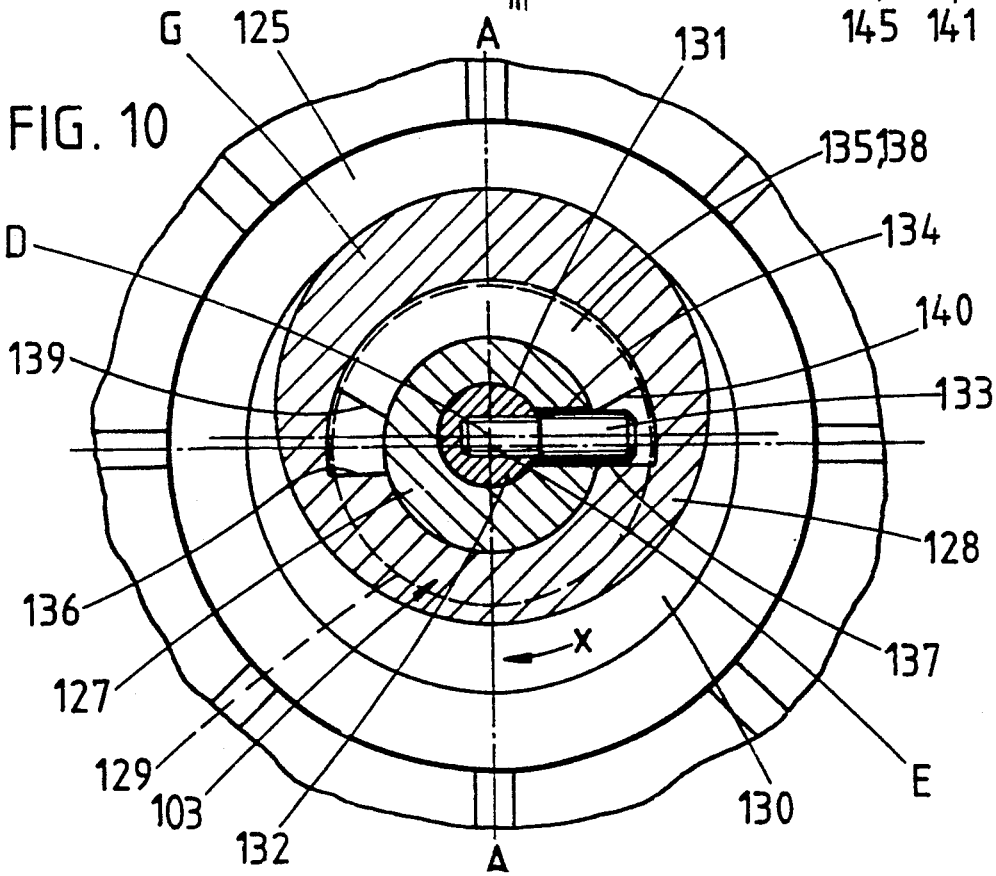
FIG. 10 is a section along the line X—X of FIG. 9.

FIGS. 8 to 10 shows a second embodiment of a thread storage developed as a delivery device, in which a bristle ring (not shown) such as described in the first embodiment of the invention is provided.

The delivery device has a housing 101, shown in dash-dot line in FIG. 8. A motor housing 102 is inserted into and fastened in said housing. The motor housing 102 carries centrally a drive shaft 103 which projects beyond the motor housing 102 and lies with this projecting section concentrically to a storage drum 104. On the drive-shaft section 103' which extends within the motor housing 102 there is keyed a rotor (not shown) which, in known manner, rotates with the drive shaft 103 within a stator, also not shown. The drive shaft 103 is rotatable in one direction of rotation or the other.

A thread guide 105 is connected, fixed for rotation, with the drive shaft 103. The thread guide has a channel 106 extending inclined at an acute angle which is in communication with a centrally arranged thread guide channel 107 in the section 103' of the drive shaft 103.

At the height of the thread guide 105, the drive shaft 103 forms a mounting section 108 on which an antifriction bearing 109 is placed. On the outside the antifriction bearing 109 is surrounding by a support disk 110 which, in its turn, extends up to the thread guide 105. The support disk 110 has magnets 111 distributed on its circumference, cooperating with opposing magnets 112 arranged on the other side of the thread guide in such a manner that the support disk 110 is prevented from turning. Arranged symmetrically to the drive shaft 103 and parallel to it, there extend from the support disk 110 support bars 113 arranged in pairs and pointing in the direction towards the head end of the storage drum 104, serving for holding a support frame 114 which extends within the storage drum 104. For further supporting of the support frame 114 there is provided an antifriction bearing 115, which surrounds a mounting section 116 of the drive shaft 103. The antifriction bearing 115 extends within a central cavity 117 in the support frame 114.

The support frame 114 serves for non-rotatably holding the pot-shaped storage drum 104. The pot bottom 118 thereof is, for this purpose, attached by screws 119 to the support frame 114. The pot bottom 118 passes, via a rounding 120, into the outer wall 121 which extends parallel to the axis of the drive shaft 103. Near the thread guide 105, the outer wall 121 is continued in a frustoconically widening run-on section 122 for the thread F. Adjoining the run-on section 122 there is a short end section 123 which extends parallel to the drive shaft 103 and is surrounded by a collar 105' of the thread guide 105.

In the outer wall 121 of the storage drum 104 there are eight longitudinally directed openings 124 arranged at equal circumferential distance apart, which openings, in their turn, are arranged staggered with respect to the support bars 113 which are arranged in pairs. These openings 124 correspond to arms 126, arranged parallel to each other, which are seated on a holder 125.

Between the two mounting sections 108 and 116, the drive shaft 103 has a section 127 with circular-cylindrical outer surface which lies eccentrically with respect to its axis of rotation D. The eccentric axis is designated by the letter E. On the eccentric section 127 there is supported for limited rotation a bushing 128 which has an inclined end section 129 facing in the direction of the antifriction bearing 115. The inclined center line M of said section intersects the eccentric axis E; see FIG. 9. The inclined end section 129 is surrounded by an antifriction bearing 130 which, in its turn, lies in a central cavity in the bipartite holder 125.

From the storage-drum side front end of the drive shaft 103, a centrally arranged bore 131 extends. In it an actuating rod 132 of circular cross section is guided for longitudinal displacement. The free end thereof bears a handle 132' which in one position of the actuating rod 132 extends at the height of the pot bottom 118. The other end of the actuating rod 132 bears a transversely directed coupling pin 133. The latter passes through a slot 134 in the eccentric section 127 of the drive shaft 103 and in the one position of the actuating rod 132 extends into an arcuate free space 135 in the bushing 128. The arcuate free space 135 extends from the corresponding end side of the bushing 128 over an angle of rotation of about 180°. The arcuate free space 135 is limited by end shoulders 136, 137. The latter are so positioned that, in the stop position of the coupling pin 133, the eccentric axis E lies in the plane of swing A—A of two opposite arms 126.

Adjoining the arcuate free space 135 there is another, supplementary arcuate free space 138. Its end shoulders 139, 140 have an angular distance from each other which is less than 180°. In the present case, an angular distance of 120° is selected. The end shoulders 139, 140 are symmetrical to the plane of swing A—A; see FIG. 10. Within the region of the arcuate free space 135, 138, the bushing 128 forms a balancing weight G on the outside.

The actuating rod 132 can be engaged in two positions, corresponding to the two arcuate free spaces 135, 138 arranged one behind the other. For this purpose, it has two annular grooves 141 and 142 arranged one behind the other. According to FIGS. 8 and 9, a detent ball 143 extends into the annular groove 141, the ball being arranged under spring action in a stud screw 144. The screw is borne by a ring 145 which is clamped on the drive shaft 103. On an end section 146 of the drive shaft 103 provided with an external thread there is threaded a nut 147 which fixes the ring 145 in its position. Both the ring 145 and the nut 147 extend within the cavity 117 in the support frame 114.

A compression spring 148 strikes against the inner end of the actuating rod 132 and urges it in the direction towards the head end. The force of the compression spring 148 is, however, less than the detent force of the detent ball 143, so that the actuating rod 132 remains in the two positions as selected at the time.

The following manner of operation results:

If this operating drive shaft 103 is driven in the direction of the arrow x shown in FIG. 10, then, by means of the thread guide 105, the thread F is deposited on the storage drum 104, wrapping around it. It first of all passes over the frustoconical run-on section 122 and from there comes onto the outer wall 121. Simultaneously with the rotation of the drive shaft 103, the coupling pin 133 is also carried along, coming against the end shoulder 137. This is possible since the mounting resistance between the bushing 128 and the holder 125 is greater than the frictional resistance between the bushing 128 and drive shaft 103. In FIGS. 8 and 9 the condition is shown in which the eccentric axis E lies at the height of the plane of swing A—A, within which the upper and lower arms 126 are located. It can furthermore be noted from FIG. 9 that the eccentric shaft E extends below the axis of rotation D. This means that the upper arm 126 is displaced into the storage drum 104 and the corresponding sections of the thread turns rest on the adjacent region on the outer wall 121. On the other hand, due to the eccentricity, the other, bottom arm 126 has protruded beyond the periphery of the outer wall 121 and supports the section of the thread turns present there. At the same time, it can be noted from FIG. 8 that the arms 126, due to the inclined end section 129 of the bushing 128, also have an inclined direction. The corresponding angle of inclination is designated $\alpha$ and corresponds to the angle of inclination of the end section 129. If the drive shaft 103 turns 180° then the eccentric axis E travels into a position of the axis of rotation D of the drive shaft 103. Since the inclined end section 129 of the bushing 128 is also shifted by 180°, the end section 129 extends inclined in opposite direction which accordingly is true also of the holder 125 with the arms 126. The angle of inclination then also corresponds to the angle α. In such case, the upper arm 126 extends over the storage-drum outer wall, while the lower arm extends into the storage drum. The thread-turn sections which previously rested on the lower arm 126 are now supported by the storage drum 104 in the corresponding region, while the upper arm 126 then comes against the thread-turn sections in the upper region of the storage drum 104. Together with the wobbling movement and the eccentricity, transport of the thread turns in the direction towards the head end is obtained.

The amplitude of swing is twice as great as the amount of the eccentricity of the eccentric axis E with respect to the axis of rotation D.

If a switching of the direction of rotation of the drive shaft 103 takes place, then the drive shaft 103 again advances ahead of the bushing 128 until the coupling pin 133 strikes the other end shoulder 136. In this position, the eccentric axis E extends above the axis of rotation D of the drive shaft 103 and also lies in the plane of swing A—A extending through the upper and lower arms 126. Accordingly, the amplitude of swing is twice as great as the eccentricity also in this case.

If the speed of the thread transport on the storage drum 104 is to be reduced, it is merely necessary to grasp the handle 132' and, by it, slightly turn the actuating rod 132 so that the coupling pin 133 comes into aligned position with the supplementary arcuate free space 138. Then a certain pull is to be exerted on the actuating rod 132, whereby the detent force exerted by the detent ball 143 is overcome. The compression spring 148 supports this process and displaces the actuating rod 132 into the position in which the detent ball 143 extends into the other annular groove 142. If, during the operation of the delivery device, the drive shaft now rotates in the direction indicated by the arrow x, the coupling end of the coupling pin 133 strikes the end shoulder 40 of the supplementary arcuate free space 138. In this connection, a phase displacement takes place between the inclined end section 129 of the bushing 128 and the eccentric axis E.

If a displacement of the eccentric axis E by 90° relative to the bushing 128 takes place, the amplitude of swing is practically zero. Upon rotation beyond this amount of 90°, the amplitude of swing then increases until, after turning 90° beyond the zero position, it again has its maximum value.

Instead of what is shown, further supplementary arcuate free spaces can also be provided as well as corresponding detent positions of the actuation bar 132 so that further changes in the transport of the thread can be effected.

Since a variation of the thread transport does not result from a change of inclination of the support, no separate springs need act on the latter. The change in advance is effected exclusively by phase displacement of the inclined end section 129 with respect to the eccentrically located section 127 of the drive shaft 103.

As an alternative, it is possible, instead of placing the holder in inclined position on the end section, to have the latter run inclined onto the drive shaft and to place the eccentric thereon.

Together with the changing of the direction of rotation of the drive shaft 103, there takes place, as described in the first embodiment, a change in the alignment of the bristles, either automatically by spring action, electrically by a servomotor, or via a magnet.

I claim:

1. A thread storage and delivery device for overhead withdrawal of thread turns deposited on a storage drum, comprising a storage drum having a frustoconical outer surface, a ring comprising adjustable bristles, said bristles being applied in a non-radial direction of alignment onto said frustoconical outer surface of the storage drum, and said ring constitutes means for changing said direction of alignment of the bristles on said outer surface.

2. The device according to claim 1, wherein said ring comprises a body, and bristle holders which support several of said bristles in bundles, said bristle holders are swingably arranged in said body, and means for limiting swinging of said bristle holders.

3. The device according to claim 2, wherein said bristle holders are spaced from each other.

4. The device according to claim 1, wherein said ring comprises an annular holder part and an annular control part which is mounted for rotary displacement relative to said holder part, and substantially cylindrical bristle holders support said bristles, each of said bristle holders is swingably mounted in said holder part around an axis of said bristle holder, said axis is parallel to direction of the withdrawal of the thread.

5. The device according to claim 4, wherein said ring further comprises mounting cups in said holder part, said bristle holders are mounted in said mounting cups.

6. The device according to claim 4, wherein said ring further comprises, a control pin arranged on each bristle holder on a side thereof opposite the bristles, and said control part is formed with a control slot, said control part is rotatably displaceable with respect to said holder part, and said control pin engages into said control slot.

7. The device according to claim 4, wherein said substantially cylindrical bristle holders are spaced from each other.

8. A device according to claim 1, wherein said ring has a frame-like outlet window on an inner side of the ring through which said bristles extend.

9. A device according to claim 1, further comprising a reversably rotatable drive shaft, said storage drum has an outer wall having openings and a head-side end, arms are respectively arranged in said outer wall openings of said storage drum, thread guide means, rotatably driven by said drive shaft with a drive force, for rotatably depositing said thread turns on said storage drum and respective of said arms which extends through a corresponding of said openings, a holder on which said arms are seated, said holder is arranged eccentrically and adjustable inclined on said drive shaft such that independent of direction of rotation of said thread guide means by said drive shaft respective of said arms extend through said openings and said thread turns are transported towards said head-side end of the storage drum, whereby the changing of said direction of alignment of said bristles for adaptation to direction of rotation of the thread guide means automatically results from said drive force of the drive shaft.

10. A device according to claim 9, wherein said drive shaft has an eccentric section, a bushing disposed on said eccentric section mounts said holder inclined at an acute angle to an axis of said storage drum, said bushing has end shoulders defining an arcuate free space therebetween extending over about 180°, and a coupling pin extends in said eccentric section into said free space for transmitting rotary movement of said drive shaft to said bushing such that said coupling pin drives said bushing by abutment against a corresponding of said end shoulders of said arcuate free space.

11. The device according to claim 1, wherein said means automatically changes said direction of alignment by action of said thread along on said bristles upon changing of direction of thread turns deposited on said storage drum by following corresponding changed direction of the withdrawal of said thread turns.

* * * * *